United States Patent [19]

Hara et al.

[11] Patent Number: 4,728,600

[45] Date of Patent: Mar. 1, 1988

[54] HEAT-DEVELOPABLE LIGHT-SENSITIVE MATERIAL

[75] Inventors: Hiroshi Hara; Toshiaki Aono, both of Kanagawa, Japan

[73] Assignee: Fuji Photo Film Co., Ltd., Kanagawa, Japan

[21] Appl. No.: 853,061

[22] Filed: Apr. 17, 1986

[30] Foreign Application Priority Data

Apr. 17, 1985 [JP] Japan ..... 60-82008

[51] Int. Cl.[4] ..... G03C 1/40; G03C 5/54

[52] U.S. Cl. ..... 430/559; 430/599; 430/570; 430/619; 430/543; 430/617; 430/620; 430/612; 430/562; 430/560; 430/550; 430/203; 430/351; 430/353

[58] Field of Search ..... 430/619, 617, 620, 612, 430/559, 562, 543, 570, 560, 550, 599, 203, 351, 353, 551

[56] References Cited

U.S. PATENT DOCUMENTS

| | | | |
|---|---|---|---|
| 3,893,860 | 7/1975 | Sutton et al. | 430/619 |
| 4,220,709 | 9/1980 | de Mauriac | 430/620 |
| 4,258,129 | 3/1981 | Ikenoue et al. | 430/620 |
| 4,273,845 | 6/1981 | Kobayashi et al. | 430/620 |
| 4,603,103 | 7/1986 | Hirai et al. | 430/617 |

FOREIGN PATENT DOCUMENTS 0101194 2/1984 European Pat. Off. .

*Primary Examiner*—Won H. Louie
*Attorney, Agent, or Firm*—Sughrue, Mion, Zinn, Macpeak and Seas

[57] ABSTRACT

A heat-developable light-sensitive material is described, comprising a support having thereon at least (1) a light-sensitive silver halide, (2) a silver salt oxidizing agent, (3) silver salt particles having adsorbed thereon at least one compound selected from a cyclic imino compound represented by formula (I) described below and a mercapto compound represented by formula (II) described below, (4) a reducing agent, and (5) a binder.

Formula (I) is represented by (I)

wherein Z represents a non-metallic atomic group forming a heterocyclic ring containing an imino group together with the nitrogen atom of formula (I).

Formula (II) is represented by

R—S—M (II)

wherein M represents a hydrogen atom or an alkali metal atom; and R represents a substituted or unsubstituted aliphatic hydrocarbon group, a substituted or unsubstituted aromatic hydrocarbon group, or a substituted or unsubstituted heterocyclic group.

The heat-developable light-sensitive material has excellent stability during preservation and provides images having high image density and low fog even in the case of a short period of developing time.

28 Claims, No Drawings

HEAT-DEVELOPABLE LIGHT-SENSITIVE MATERIAL

FIELD OF THE INVENTION

The present invention relates to a heat-developable light-sensitive material, particularly to a heat-developable light-sensitive material which has improved developability and preservability.

BACKGROUND OF THE INVENTION

Photographic processes using silver halide have been widely used in the past due to their excellent photographic properties such as sensitivity or control of gradation, etc., as compared with other photographic processes, such as an electrophotographic process or a diazo photographic process. In recent years, with respect to image formation processes for light-sensitive materials using silver halide, many techniques capable of easily and quickly providing images have been developed by changing from conventional wet processes using a developing solution to dry development processes, such as processes using heat, etc.

Heat-developable light-sensitive materials are thus well known in this field. Heat-developable light-sensitive materials and processes therefor have been described, for example, in *Shashin Kogaku no Kiso* (*The Foundation of Photographic Technology*), pages 553–555 (published by Corona Co., 1979), *Eizo Joho* (*The Image Information*), page 40 (April, 1978), *Neblette's Handbook of Photography and Reprography*, 7th Ed., pages 32–33 (Van Nostrand Reinhold Company), 1977; U.S. Pat. Nos. 3,152,904, 3,301,678, 3,392,020, and 3,457,075; British Pat. Nos. 1,131,108 and 1,167,777; and *Research Disclosure*, RD No. 17029, pages 9–15 (June, 1978).

Many different processes for obtaining color image have been proposed. With respect to processes for forming color images by the reaction of an oxidation product of a developing agent with a coupler, it has been proposed to use a p-phenylenediamine type reducing agent and a phenolic coupler or an active methylene coupler as described in U.S. Pat. No. 3,351,286, a p-aminophenol type reducing agent as described in U.S. Pat. No. 3,761,270, a sulfonamidophenol type reducing agent as described in Belgian Pat. No. 802,519 and *Research Disclosure*, RD No. 137 pages 31–32 (September, 1975) and the combination of a sulfonamidophenol type reducing agent and a 4-equivalent coupler as described in U.S. Pat. No. 4,021,240.

Also, processes and materials for forming a positive color image by a light-sensitive silver dye bleach process are described, for example, in *Research Disclosure*, RD No. 14433, pages 30–32 (April, 1976), ibid., RD No. 15227, pages 14–15 (December, 1976) and U.S. Pat. No. 4,235,957, etc.

Further, processes for forming images upon heat-development utilizing compounds having a dye moiety which are capable of releasing a mobile dye in correspondence or counter-correspondence to the reduction reaction of silver halide to silver under high temperature conditions have been described, for example, in European Pat. Nos. 76,492A and 79,056A, Japanese Patent Application (OPI) Nos. 28928/83 and 26008/83, etc. (The term "OPI" as used herein refers to a "published unexamined Japanese patent application".)

With these heat-developable light-sensitive materials, silver salt oxidizing agents are usually employed as suppliers of silver ions. Although such silver salt oxidizing agents are very effective in performance in heat development, they have several disadvantages. Particularly, when the heating temperature is elevated or heating time is prolonged for the purpose of obtaining sufficiently high density, the minimum density (fog density) increases, and a large decrease in sensitivity occurs during preservation before exposure of light-sensitive materials in which a spectrally sensitized silver halide and a silver salt oxidizing agent are coexistent.

Further, it has been desired to shorten the time of development step as much as possible, and thus, investigations on various kinds of development accelerators have been made.

SUMMARY OF THE INVENTION

Therefore, an object of the present invention is to provide a technique for improvement of preservability of heat-developable light-sensitive material containing silver salt oxidizing agents and providing images having high image density and low fog density within a short period of developing time.

Other objects of the present invention will become apparent from the following detailed description and examples.

These objects of the present invention can be accomplished with a heat-developable light-sensitive material comprising a support having thereon at least (1) a light-sensitive silver halide, (2) a silver salt oxidizing agent, (3) silver salt particles having adsorbed thereon at least one compound selected from a cyclic imino compound represented by formula (I) described below and a mercapto compound represented by formula (II) described below, (4) a reducing agent, and (5) a binder.

Formula (I) is represented by

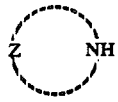

(I)

wherein Z represents a non-metallic atomic group forming a hetero ring containing an imino group together with the nitrogen atom of formula (I).

Formula (II) is represented by $$R—S—M \qquad \text{(II)}$$

wherein M represents a hydrogen atom or an alkali metal atom; and R represents a substituted or unsubstituted aliphatic hydrocarbon group, a substituted or unsubstituted aromatic hydrocarbon group, or a substituted or unsubstituted heterocyclic group.

DETAILED DESCRIPTION OF THE INVENTION

The heat-developable light-sensitive material according to the present invention is characterized by containing silver salt particles on which at least one kind of compounds selected from a cyclic imino compound represented by formula (I) and a mercapto compound represented by formula (II) is adsorbed.

Preferred silver salt particles which can be used in the present invention are salt particles composed of a silver ion and a chlorine ion, a bromine ion, an iodine ion, a thiocyanate ion, a selecyanate ion, a sulfite ion, a sulfate ion, a phosphate ion, or a complex ion thereof.

It is preferred that the silver salt particles employed in the present invention are substantially light-insensitive compared with the light-sensitive silver halide. More specifically, those having sensitivity of one tenth of or less than that of the light-sensitive silver halide are preferable.

In case of using silver halide particles as the silver salt particles, therefore, it is described to utilize primitive (i.e., not subjected to chemical sensitization procedure) silver chloride, silver bromide, or silver chlorobromide, or a mixture thereof. However, it is also possible to use a silver halide containing a small amount (i.e., 5 mol % or less) of iodide.

The particle size of the silver salt particles is preferably in a range of from 0.01 μm to 2 μm, and particularly preferably in a range of from 0.05 μm to 0.5 μm. It is more particularly preferred to employ the silver salt particles having an average particle size smaller than that of the light-sensitive silver halide used together.

Particularly preferred silver salt particles used in the present invention are a fine grain emulsion of primitive pure silver chloride.

The cyclic imino compound represented by formula (I) and the merapto compound represented by formula (II) each of which is used to adsorb on the silver salt particles is described in detail in the following.

Of the cyclic imino compounds represented by formula (I) described above, those represented by formulae (III) to (XI) described below are preferably used in the present invention.

(III)

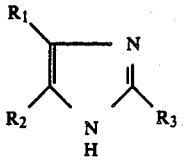

(IV)

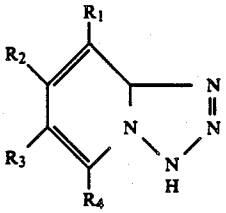

(V)

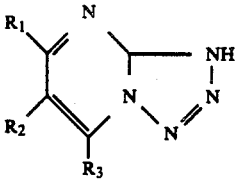

(IV)

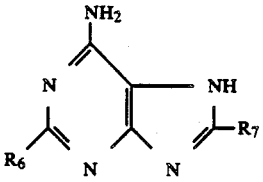

(VII)

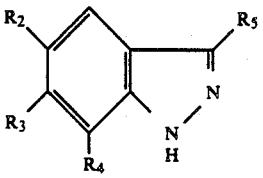

-continued (VIII)

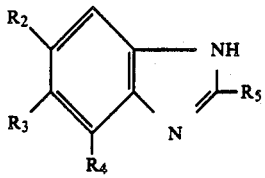

(IX)

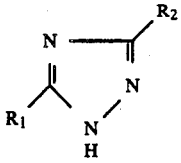

(X)

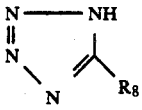

(XI)

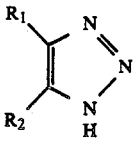

wherein $R_1$, $R_2$, $R_3$ and $R_4$, (which may be the same or different), each represents a hydrogen atom, an alkyl group, an aralkyl group, an alkenyl group, an alkoxy group, an aryl group, —NRR', —COOR'', —CONRR', —$NHSO_2R$, —$SO_2NRR'$, —$NO_2$, a halogen atom, —CN, or —OH (wherein R and R' (which may be the same or different) each represents a hydrogen atom, an alkyl group, an aryl group, or an aralkyl group; R'' represents an alkyl group, an aryl group, or an aralkyl group and when both $R_1$ and $R_2$ represent alkyl groups, they can be bonded to each other to form an aliphatic hydrocarbon ring, or $R_1$ and $R_2$ in formula (XI) can be further bonded to each other to form an aromatic hydrocarbon ring; $R_5$ represents a hydrogen atom, an alkyl group having from 1 to 5 carbon atoms, or —S—R''' (wherein R''' represents a hydrogen atom, an alkyl group, an aryl group, or an aralkyl group); $R_6$ represents a hydrogen atom or an alkyl group; $R_7$ represents a hydrogen atom, an alkyl group, or an aryl group; and $R_8$ represents an alkyl group, an aryl group, a benzyl group, or a pyridyl group.

Of the mercapto compounds represented by formula (II) described above, those represented by formula (XII) described below are preferably used in the present invention.

Formula (XII) is represented by (XII)

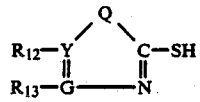

wherein Q represents an oxygen atom, a sulfur atom, or —NR'''' (wherein R'''' represents a hydrogen atom, an alkyl group, an unsaturated alkyl group, a substituted, or unsubstituted aryl group, or a substituted or unsubstituted aralkyl group); Y and G (which may be the same or different) each represents a carbon atom or a nitrogen atom; and $R_{12}$ and $R_{13}$ (which may be the same or different) each represents a hydrogen atom, an alkyl group, an unsaturated alkyl group, a substituted or unsubstituted aryl group, a substituted or unsubstituted aralkyl group, —SR''''' (wherein R''''' represents a hydrogen atom, an alkyl group, an aryl group, an aralkyl group, an alkyl carboxylic acid group or an alkali metal salt thereof, or an alkyl sulfonic acid group or an alkali metal salt thereof) or —$NH_2$; and when both Y and G represent carbon atoms, $R_{12}$ and $R_{13}$ can be bonded to each other to form a substituted or unsubstituted aromatic hydrocarbon ring or a substituted or unsubstituted nitrogen-containing hetero ring.

Among the compounds represented by formulae (III) to (XII) described above, those which do not contain a carboxylic acid group or a sulfonic acid group as a substituent are particularly preferred since they exhibit good effect according to the present invention.

Specific examples of the typical compounds represented by formulae (III) to (XII) described above are set forth below, but the present invention should not be construed as being limited thereto.

(1)

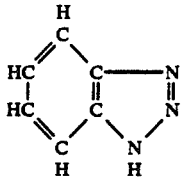

(2)

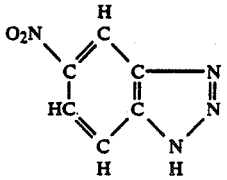

(3)

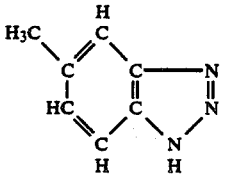

(4)

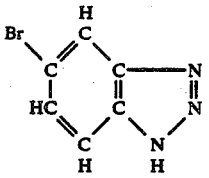

(5)

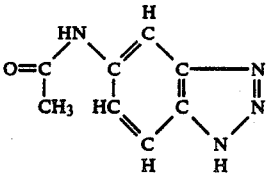

(6)

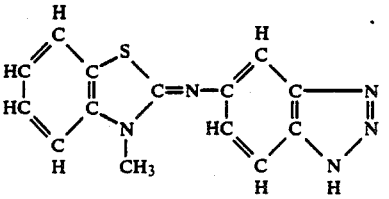

-continued (7)

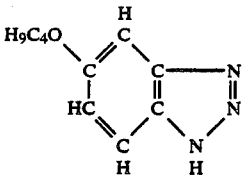

(8)

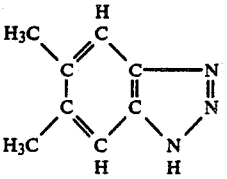

(9)

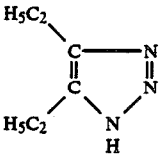

(10)

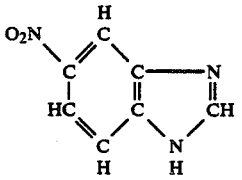

(11)

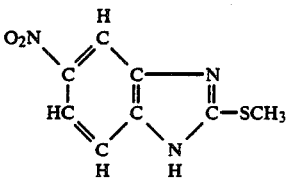

(12)

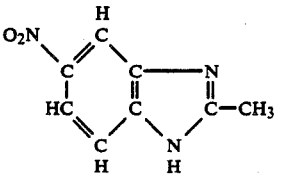

(13)

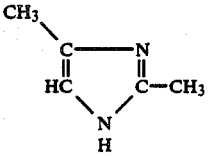

(14)

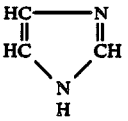

(15)

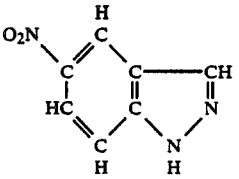

-continued
(16)
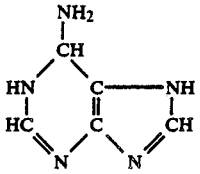
(17)
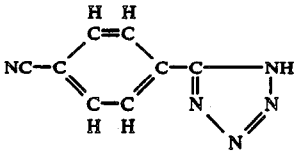
(18)
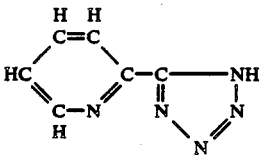
(19)
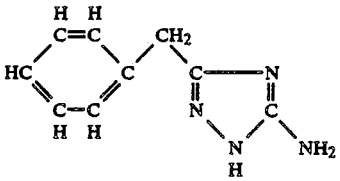
(20)
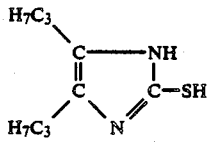
(21)
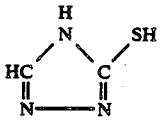
(22)
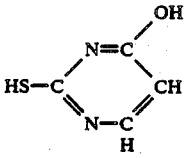
(23)
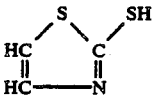
(24)
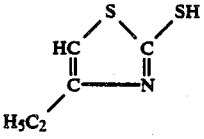
(25)
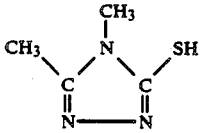
-continued
(26)
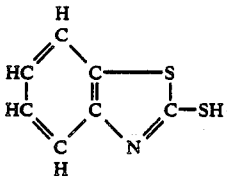
(27)
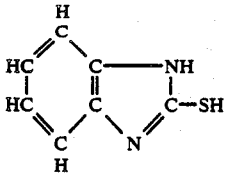
(28)
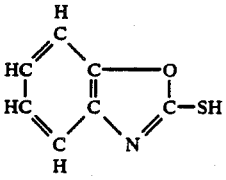
(29)
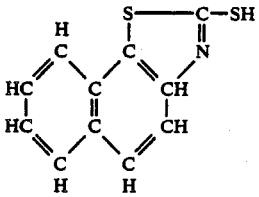
(30)
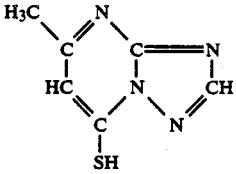
(31)
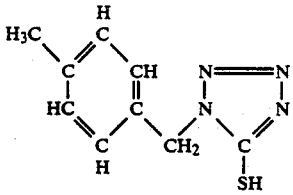
(32)
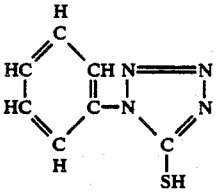
(33)
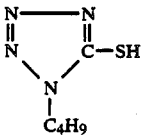

-continued (34)

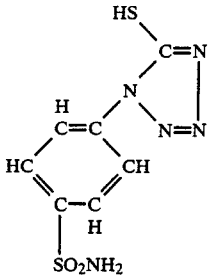

(35)

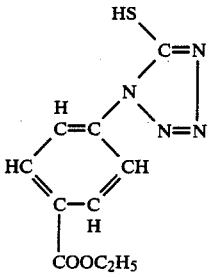

(36)

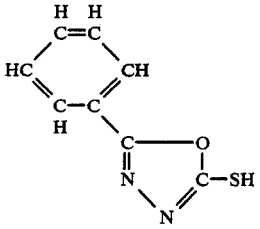

(37)

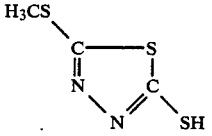

(38)

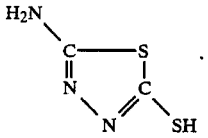

(39)

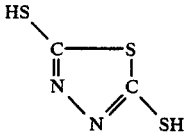

(40)

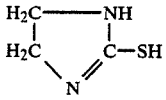

(41)

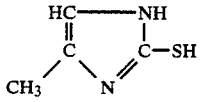

(42)

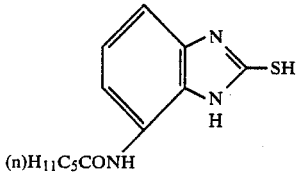

-continued (43)

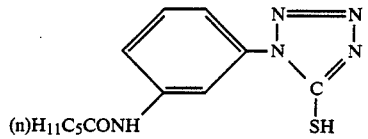

In order to prepare silver salt particles on which at least one kind of compounds selected from the cyclic imino compounds and the mercapto compounds described above is adsorbed, it is convenient that the silver salt particles are formed in the presence of such a compound or the silver salt particles are ripened in the presence of such a compound.

In such cases, it is preferred that the compound according to the present invention is employed in a range of from 0.01 mol% to 10 mol%, and particularly preferably from 0.05 mol% to 5 mol%, of the silver in the silver salt particles.

While it is preferred to add the silver salt particles having adsorbed thereon at least one kind of compounds selected from the compounds represented by formulae (I) and (II) described above to a light-sensitive silver halide emulsion layer, they may be added to other hydrophilic colloid layers.

The silver salt particles according to the present invention are used in an amount of from 1 mol% to 200 mol%, and preferably from 5 mol% to 100 mol%, of the light-sensitive silver halide.

Preferred examples of the light-sensitive silver halide used in the present invention include silver iodide, silver bromide, silver chloride, silver iodobromide, silver chlorobromide, silver chloroiodobromide, and mixtures thereof. High sensitive silver iodobromide is particularly preferred.

A halogen composition in the silver halide grains may be uniform or the silver halide grains may have a multilayer structure in which the composition is different between a surface portion and an inner portion (see Japanese Patent Application (OPI) Nos. 154232/82 (U.S. Pat. No. 4,444,877), 108533/83, 48755/84 (U.S. Pat. No. 4,507,386), and 52237/84, U.S. Pat. No. 4,433,048 and European Pat. No. 100,984, etc.).

Also a tabular grain silver halide emulsion containing grains having a thickness of 0.5 μm or less, a diameter of at least 0.6 μm, and an average aspect ratio of 5 or more (see U.S. Pat. Nos. 4,414,310 and 4,435,499, and West German Patent Application (OLS) No. 3,241,646A1, etc.), and a mono-dispersed emulsion having a nearly uniform distribution of grain size (see Japanese Patent Application (OPI) Nos. 178235/82 (U.S. Pat. No. 4,446,228), 100846/83 (U.S. Pat. Nos. 4,446,226 and 4,511,648), and 14829/83, PCT Application (OPI) No. 83/02338A1, and European Pat. Nos. 64,412A3 and 83,377A1, etc.) may be used in the present invention.

Two or more kinds of silver halides in which a crystal habit, a halogen composition, a grain size and/or a distribution of grain size, etc., are different from each other may be used in mixture. Further, two or more kinds of mono-dispersed emulsions having different grain size from each other may be employed in mixture to control gradation.

An average grain size of the silver halide used in the present invention is preferably from 0.001 μm to 10 μm and more preferably from 0.001 μm to 5 μm.

These silver halide emulsions can be prepared by any of an acid process, a neutral process, and an ammonia process. Further, a reaction system of soluble silver salts and soluble halogen salts may be any of a single jet process, a double jet process, and a combination thereof. In addition, a reverse mixing process in which silver halide grains are formed in the presence of an excess of silver ions, or a controlled double jet process in which the pAg in the liquid phase is kept constant, can also be utilized.

Moreover, for the purpose of increase in growth of grains, a concentration, amount and/or speed of addition of silver salts and halogen salts to be added may be raised (see Japanese Patent Application (OPI) Nos. 142329/80 and 158124/80, and U.S. Pat. No. 3,650,757, etc.).

Furthermore, silver halide grains of epitaxial junction type (see Japanese Patent Application (OPI) No. 16124/81, and U.S. Pat. No. 4,094,684, etc.) may be employed.

In the step of formation of silver halide grains which can be used in the present invention, ammonia, an organic thioether derivative as described in Japanese Patent Publication No. 11386/72, or a compound containing sulfur as described in Japanese Patent Application (OPI) No. 144319/78, etc., can be used as a solvent for silver halide.

In a process of the formation or physical ripening of silver halide grains, a cadmium salt, a zinc salt, a lead salt, or a thallium salt, etc., may be coexistent. Further, for the purpose of eliminating high-intensity reciprocity law failure or low-intensity reciprocity law failure, a water-soluble iridium salt such as iridium (III, IV) chloride, ammonium hexachloroiridiate, etc, or a water-soluble rhodium salt such as rhodium chloride, etc., can be used.

Soluble salts may be removed from the silver halide emulsion after precipitate formation or physical ripening, and a noodle washing process or a flocculation process can be used for this purpose.

While the silver halide emulsion may be employed without being subjected to after-ripening, it is usually chemically sensitized. For the chemical sensitization, a sulfur sensitization method, a reduction sensitization method, and a noble metal sensitization method, etc., which is known in the field of emulsions for conventional type photographic light-sensitive materials can be applied alone or in combination therewith. Such a chemical sensitization may be carried out in the presence of a nitrogen-containing heterocyclic compound (see Japanese Patent Application (OPI) Nos. 126526/83 and 215644/83, etc.).

The silver halide emulsion used in the present invention can be those in which a latent image is formed mainly on the surface of grains, or those in which a latent image is formed mainly in the interior of grains. Further, a direct reversal emulsion in which an internal latent image type emulsion and a nucleating agent are used in a combination may be used. Examples of the internal latent image type emulsions suitable for this purpose are described in U.S. Pat. Nos. 2,592,250 and 3,761,276, Japanese Patent Publication No. 3534/83, and Japanese Patent Application (OPI) No. 136641/82, etc. Preferred examples of the nucleating agents suitably used in the present invention are described in U.S. Pat. Nos. 3,227,552, 4,245,037, 4,255,511, 4,266,031, and 4,276,364, and West German Patent Application (OLS) No. 2,635,316, etc.

The coating amount of the light-sensitive silver halide used in the present invention is preferably in a range of from 1 mg/m$^2$ to 10 g/m$^2$, calculated based on the amount of silver.

The effect of the present invention is particularly large when a spectrally sensitized light-sensitive silver halide emulsion is employed. Suitable dyes which can be employed for spectral sensitization include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes is applicable to these dyes as a basic heterocyclic nucleus. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing an alicyclic hydrocarbon ring with these nuclei and nuclei formed by condensing an aromatic hydrocarbon ring with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolin-2,4-dione nucleus, a thiazolidin-2,4-dione nucleus, a rhodanine nucleus, a thiobarbituric acid nucleus, etc., may also be applicable.

Specific examples of useful sensitizing dyes are set forth below.

D-1

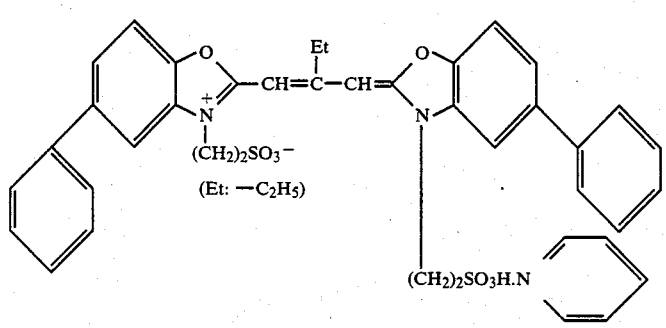

-continued
D-2
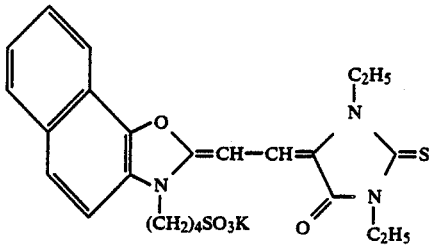
D-3
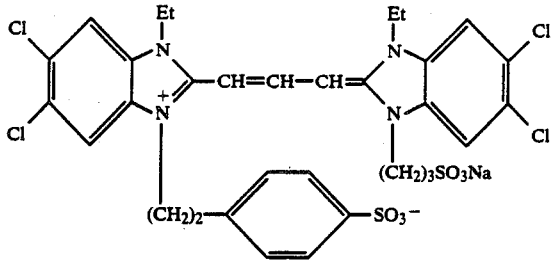
D-4
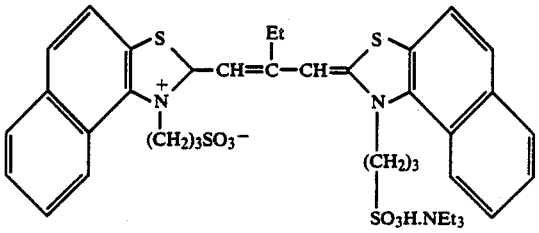
D-5
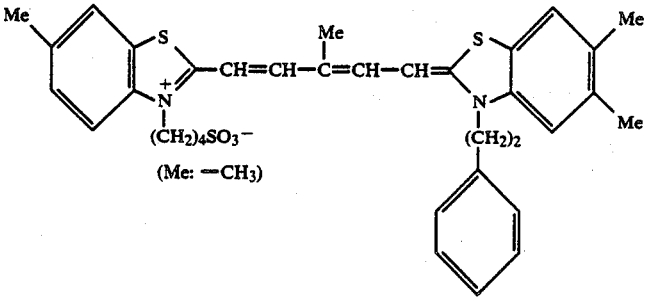
D-6
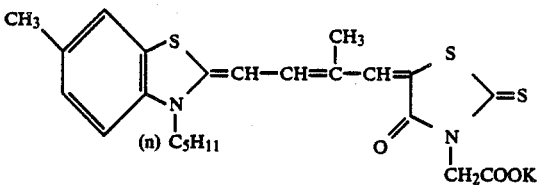
D-7
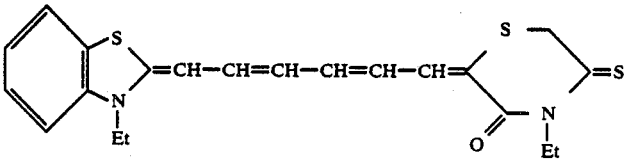

-continued

D-8

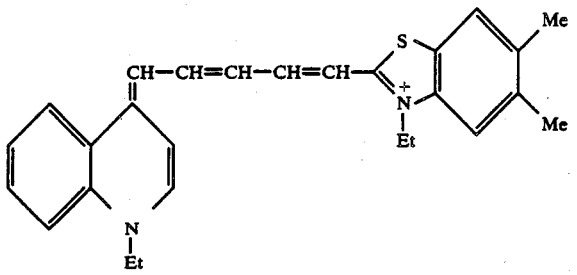

These sensitizing dyes can be employed individually, and can also be employed in combination thereof. A combination of sensitizing dyes is often used, particularly for the purpose of supersensitization.

Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,309, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects, but which exhibit a supersensitizing effect, or materials which do not substantially absorb visible light, but which exhibit a supersensitizing effect. For example, aminostilbene compounds substituted with a nitrogen-containing heterocyclic group (for example, those described in U.S. Pat. Nos. 2,933,390 and 3,635,721), aromatic organic acid-formaldehyde condensates (for example, those described in U.S. Pat. No. 3,743,510), cadmium salts, azaindene compounds, etc., can be present. The combinations as described in U.S. Pat. Nos. 3,615,613, 3,615,641, 3,617,295, and 3,635,721 are particularly useful.

In order to incorporate the sensitizing dye into a silver halide photographic emulsion, it may be directly dispersed in the silver halide emulsion or it may be dissolved in a solvent such as water, methanol, ethanol, acetone, methyl cellosolve, etc., alone or as a mixture thereof, and then the solution is added to the silver halide emulsion. Further, the sensitizing dye is dissolved in a solvent which is substantially immiscible with water such as phenoxyethanol, etc., the solution is then dispersed in water or a hydrophilic colloid, and thereafter the dispersion is added to the silver halide emulsion. Moreover, the sensitizing dye is mixed with an oleophilic compound such as a dye providing compound, etc., and added simultaneously to the silver halide emulsion.

In the case of using a combination of the sensitizing dyes, these sensitizing dyes may be separately dissolved or a mixture thereof may be dissolved. Furthermore, these sensitizing dyes may be added separately or simultaneously as a mixture to the silver halide emulsion. They may be added together with other additives to the emulsion.

The period for the addition of the sensitizing dye to the silver halide emulsion may be before, during, or after the chemical ripening, or before, during, or after the formation of silver halide grains, as described in U.S. Pat. Nos. 4,183,756 and 4,225,666.

The amount added is generally in a range from about $10^{-8}$ mol to about $10^{-2}$ mol per mol of silver halide.

In the present invention, a silver salt oxidizing agent is used as a silver ion together with the light-sensitive silver halide. Of these silver salts, an organic silver salt oxidizing agent which is relatively stable to light is particularly preferred. In this case, it is necessary that the light-sensitive silver halide and the organic silver salt oxidizing agent are present in a contact state or in close relationship.

In the case of using the organic silver salt oxidizing agent together with the silver halide, it is thought that the organic silver salt oxidizing agent also contributes to redox reaction in the presence of a latent image of silver halide as a catalyst, when the heat-developable light-sensitive material is heated to a temperature of above 80° C., and preferably above 100° C.

Examples of organic compounds which can be used for forming the above-described organic silver salt oxidizing agent include an aliphatic or aromatic carboxylic acid, a compound containing a mercapto group or a thiocarbonyl group having an $\alpha$-hydrogen atom, and a compound containing an imino group, etc.

Typical examples of the silver salts of aliphatic carboxylic acids include a silver salt derived from behenic acid, stearic acid, oleic acid, lauric acid, capric acid, myristic acid, palmitic acid, maleic acid, fumaric acid, tartaric acid, Freund's acid, linolic acid, linoleic acid, adipic acid, sebacic acid, succinic acid, acetic acid, butyric acid, and camphoric acid. Also, a silver salt derived from such an aliphatic carboxylic acid substituted with a halogen atom or a hydroxyl group, or an aliphatic carboxylic acid having a thioether group, etc. can be used.

Typical examples of the silver salts of aromatic carboxylic acids and other carboxyl group-containing compounds include a silver salt derived from benzoic acid, 3,5-dihydroxybenzoic acid, o-methylbenzoic acid, m-methylbenzoic acid, p-methylbenzoic acid, 2,4-dichlorobenzoic acid, acetamidobenzoic acid, p-phenylbenzoic acid, gallic acid, tannic acid, phthalic acid, terephthalic acid, salicylic acid, phenylacetic acid, pyromellitic acid, and 3-carboxymethyl-4-methyl-4-thiazolin-2-thione, etc.

Examples of the silver salts of compounds containing a mercapto group or a thiocarbonyl group include a silver salt derived from 3-mercapto-4-phenyl-1,2,4-triazole, 2-mercaptobenzimidazole, 2-mercapto-5-aminothiadiazole, 2-mercaptobenzothiazole, an S-alkyl thioglycolic acid (wherein the alkyl group has from 12 to 22 carbon atoms), a dithiocarboxylic acid such as dithioacetic acid, etc., a thioamide such as thiostearoylamide, etc., 5-carboxy-1-methyl-2-phenyl-4-thiopyridine, and a mercapto compound such as mercaptotriazine, 2-mercaptobenzoxazole, mercaptooxadiazole, or 3-amino-5-benzylthio-1,2,4-triazole, etc., as described in U.S. Pat. No. 4,123,274, etc.

Typical examples of the silver salts of compounds containing an imino group include a silver salt derived from a benzotriazole or a derivative thereof as described in Japanese Patent Publication Nos. 30270/69 and 18416/70, for example, benzotriazole, an alkyl substituted benzotriazole such as methylbenzotriazole, etc., a halogen substituted benzotriazole such as 5-chlorobenzotriazole, etc., a carboimidobenzotriazole such as butylcarboimidobenzotriazole, etc., a nitrobenzotriazole as described in Japanese Patent Application (OPI) No. 118639/83, a sulfobenzotriazole, a carboxybenzotriazole or a salt thereof, a hydroxybenzotriazole, etc. as described in Japanese Patent Application (OPI) No. 118638/83, a 1,2,4-triazole or a 1H-tetrazole as described in U.S. Pat. No. 4,220,709, a carbazole, a saccharin, an imidazole, and a derivative thereof, etc.

Moreover, a silver salt as described in *Research Disclosure,* RD No. 17029 (June, 1978) and a silver salt of a carboxylic acid having an alkyl group such as phenylpropiolic acid, etc. as described in Japanese Patent Application (OPI) No. 113235/85 (U.S. application Ser. No. 675,040, filed Nov. 26, 1984) can also be used in the present invention.

The organic silver salt oxidizing agent can be employed in a range from 0.01 mol to 10 mols, and preferably from 0.01 mol to 1 mol per mol of the light-sensitive silver halide. The total coating amount of the light-sensitive silver halide and the organic silver salt oxidizing agent is generally from 50 mg/m$^2$ to 10 g/m$^2$.

In the present invention, a reducing agent is incorporated into the light-sensitive material. The reducing agents which can be used in the present invention include dye providing substances having a reducing property. Further, precursors of reducing agents which do not have a reducing property themselves but exhibit a reducing property due to action of a nucleophilic reagent or heat in the process of development are also included.

Examples of the reducing agents which can be used in the present invention include an inorganic reducing agent such as sodium sulfite, sodium hydrogen sulfite, etc., a benzenesulfinic acid, a hydroxylamine, a hydrazine, a boran-amine complex, a hydroquinone, an aminophenol, a catechol, a p-phenylenediamine, a 3-pyrazolidinone, a hydroxytetronic acid, an ascorbic acid, a 4-amino-5-pyrazolone, etc. Reducing agents as described in T. H. James, *The Theory of the Photographic Process,* Fourth Edition, 1977, pp. 291 to 334 can also be employed. Further, reducing agent precursors as described in Japanese Patent Application (OPI) Nos. 138736/81 (U.S. Pat. No. 4,366,240) and 40245/82, U.S. Pat. No. 4,330,617, etc., can be employed.

Examples of more preferred reducing agents include the following compounds.

3-Pyrazolidones and precursors thereof (for example, 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone, 1,5-diphenyl-3-pyrazolidone, 1-phenyl-4-methyl-4-stearoyloxymethyl-3-pyrazolidone, 1-phenyl-4-methyl-4-lauroyloxymethyl-3-pyrazolidone, 1-phenyl-4,4-bis(lauroyloxymethyl)-3-pyrazolidone, 1-phenyl-2-acetyl-3-pyrazolidone, 1-phenyl-3-acetoxypyrazolidone, etc.); and hydroquinones and precursors thereof (for example, hydroquinone, toluhydroquinone, 2,6-dimethylhydroquinone, tert-butylhydroquinone, 2,5-di-tert-butylhydroquinone, tert-octylhydroquinone, 2,5-di-tert-octylhydroquinone, pentadecylhydroquinone, sodium 5-pentadecylhydroquinone-2-sulfonate, p-benzoyloxyphenol, 2-methyl-4-benzoyloxyphenol, 2-tert-butyl-4-(4-chlorobenzoyloxy)phenol, etc.).

Various combinations of reducing agents as described in U.S. Pat. No. 3,039,869 can also be used.

In the present invention, the amount of the reducing agent added is generally from 0.01 mol to 10 mols per mol of silver, and more preferably from 0.1 mol to 10 mols per mol of silver.

In the present invention, a wide variety of image-forming substances can be employed in various manners, in addition to the use of silver as an image-forming substance.

For instance, a compound which forms a diffusible dye or releases a diffusible dye in correspondence or counter-correspondence to the reaction wherein the light-sensitive silver halide is reduced to silver under a high temperature condition, that is, a dye-providing substance can be used in the present invention.

It is preferred that the diffusible dyes are generated imagewise when the light-sensitive material used in the present invention is heated after imagewise exposure or simultaneously with imagewise exposure.

The dye-providing substances are described in more detail below.

An example of the dye-providing substance which can be used in the present invention is a coupler capable of reacting with a developing agent. A method utilizing such a coupler can form a dye upon a reaction of the coupler with an oxidation product of a developing agent which is formed by an oxidation reduction reaction between the silver salt and the developing agent and is described in many literatures. Specific examples of the developing agents and the couplers are described in greater detail, for example, in T. H. James, *The Theory of the Photographic Process,* Fourth Edition, 1977, pp. 291 to 334 and pp. 354 to 361; and Shinichi Kikuchi, *Shashin Kagaku* (Photographic Chemistry), Fourth Edition, pp. 284 to 295, Kyoritsu Shuppan Co., etc.

Another example of the dye-providing substance is a dye-silver compound in which an organic silver salt is connected to a dye. Specific examples of the dye-silver compounds are described in *Research Disclosure,* RD No. 16966, pp. 54 to 58 (May, 1978), etc.

Still another example of the dye-providing substance is an azo dye used in a heat-developable silver dye-bleaching process. Specific examples of the azo dyes and the method for bleaching are described in U.S. Pat. No. 4,235,957, *Research Disclosure,* RD No. 14433, pp. 30 to 32 (April, 1976), etc.

A further example of the dye-providing substance is a leuco dye as described in U.S. Pat. Nos. 3,985,565 and 4,022,617, etc.

A still further example of the dye-providing substance is a compound having a function of imagewise releasing or diffusing a diffusible dye.

This type of compound can be represented by formula (LI)

$$(\text{Dye}—X)_n—Y \quad \text{(LI)}$$

wherein Dye represents a dye moiety or a dye precursor moiety; X represents a simple bond or a connecting group; Y represents a group having such a property that diffusibility of the compound represented by $(\text{Dye}—X)_n—Y$ can be differentiated in correspondence or counter-correspondence to light-sensitive silver salts having a latent image distributed imagewise or a group having a property of releasing Dye in correspondence or counter-correspondence to light-sensitive silver salts having a latent image distributed imagewise, diffusibility of Dye released being different from that of the compound represented by $(\text{Dye}—X)_n—Y$; and n represents 1 or 2 and when n is 2, two Dye—X's are the same or different.

Specific examples of the dye-providing substance represented by formula (LI) are known and, for example, dye developers in which a hydroquinone type developing agent is connected to a dye component are described in U.S. Pat. Nos. 3,134,764, 3,362,819, 3,597,200, 3,544,545, and 3,482,972, etc. Further, substances capable of releasing diffusible dyes upon an intramolecular nucleophilic displacement reaction are described in Japanese Patent Application (OPI) No. 63618/76, etc., and substances capable of releasing diffusible dyes upon an intramolecular ring-opening and closing reaction of an isooxazolone ring are described in Japanese Patent Application (OPI) No. 111628/74, etc.

In any of these processes, diffusible dyes are released or diffused in portions where development did not occur. In contrast, in portions where development occurred neither release nor diffusion of dyes occur.

It is very difficult to obtain images of a high S/N ratio according to these processes, because development and release or diffusion of dyes occur in parallel. In order to eliminate this drawback, therefore, there has been provided a process in which a dye-releasing compound is previously converted to an oxidized form thereof which does not have a dye-releasing ability, the oxidized form of the compound is coexistent with a reducing agent or a precursor thereof, and after development the oxidized form of the compound is reduced with the remaining reducing agent which is not oxidized to release a diffusible dye. Specific examples of dye-providing substances which can be used in such a process are described in Japanese Patent Application (OPI) Nos. 110827/78, 130927/79, 164342/81, and 35533/78, etc.

On the other hand, substances capable of releasing diffusible dyes in portions where development occurred are also known. For example, substances capable of releasing diffusible dyes upon a reaction of couplers having diffusible dyes in the split-off groups thereof with oxidation products of developing agents are described in British Pat. No. 1,330,524, Japanese Patent Publication No. 39165/73, U.S. Pat. No. 3,443,940, etc., and substances capable of forming diffusible dyes upon a reaction of couplers having diffusion resistant groups in the split-off groups thereof with oxidation products of developing agents are described in U.S. Pat. No. 3,227,550, etc.

In these processes using color developing agents, there is a severe problem in that images are contaminated with oxidation decomposition products of the developing agents. Therefore, in order to eliminate such a problem, dye-releasing compounds which have a reducing property themselves, and thus do not need the use of developing agents, have been proposed. Typical examples of these dye-releasing compounds are described in U.S. Pat. Nos. 3,928,312, 4,053,312, 4,055,428 and 4,336,322, Japanese Patent Application (OPI) Nos. 65839/84, 69839/84, 3819/78 and 104343/76, *Research Disclosure*, RD No. 17465 (October, 1978), U.S. Pat. Nos. 3,725,062, 3,728,113, and 3,443,939, Japanese Patent Application (OPI) No. 116537/83, etc.

Any of various dye-providing substances described above can be employed in the present invention.

Specific examples of image-forming substances used in the present invention are described in the above-mentioned literatures.

Examples of the diffusible dyes include those derived from azo dyes, azomethine dyes, anthraquinone dyes, naphthoquinone dyes, styryl dyes, nitro dyes, quinoline dyes, carbonyl dyes, and phthalocyanine dyes, etc. These dyes can also be used in a form having temporarily shorter (shifted) wavelengths. Specific examples of the dye moieties in the dye-providing compounds include those described in Japanese Patent Application (OPI) No. 84236/84 (U.S. Pat. No. 4,473,631).

The dye-providing substance used in the present invention can be introduced into a layer of the light-sensitive material by known methods such as a method as described in U.S. Pat. No. 2,322,027, etc.

Further, it is possible to use a dispersion method using a polymer as described in Japanese Patent Publication No. 39853/76, Japanese Patent Application (OPI) No. 59943/76 (U.S. Pat. Nos. 4,512,969, 4,304,769, 4,247,627, 4,214,047, 4,199,363, and 4,203,716), etc. Moreover, various surface active agents can be used when the dye-providing substance is dispersed in a hydrophilic colloid. For this purpose, the surface active agents illustrated in other parts of the specification can be used.

An amount of the organic solvent having a high boiling point used in the present invention is 10 g, and preferably 5 g per g or less, per g of the dye-providing substance used or less.

In the present invention, an image-forming accelerator can be used. The image-forming accelerator has a function which accelerates the oxidation reduction reaction between a silver salt oxidizing agent and a reducing agent, a function which accelerates a reaction of forming a dye, decomposing a dye, or releasing a mobile dye from a dye-providing substance, etc. or a function which accelerates transfer of a dye from a layer of the light-sensitive material to a dye-fixing layer. From the standpoint of a physical or chemical function, they are classified into a group, for example, a base or a base precursor, a nucleophilic compound, an oil, a thermal solvent, a surface active agent, a compound having an interaction with silver or a silver ion, etc. However, such groups of substances usually show complex functions, and generally have some of the above described accelerating effects at the same time.

The details of these image-forming accelerators are described, e.g., in U.S. patent application Ser. No. 808,179, filed Dec. 13, 1985.

In the present invention, various kinds of development-stopping agents are used in the light-sensitive material for the purpose of obtaining a constant image irrespective of variation in a processing temperature and a processing time at the heat development.

The term "development-stopping agent" used herein means a compound which can rapidly neutralize a base or react with a base to decrease the concentration of the base in the layer when the development has appropriately proceeded, whereby the development is stopped or a compound which can interact with silver or a silver salt and inhibit further development.

Specific examples of the development-stopping agents are described in Japanese Patent Application (OPI) Nos. 108837/85, 230133/85, and 192939/85, etc.

Further, in the present invention, it is possible to use a compound which activates development simultaneously while stabilizing the image.

Preferred examples of the compounds used in the present invention are describedd in U.S. Pat. No. 4,500,626.

In the present invention, if desired, an image-toning agent can be incorporated into the light-sensitive material.

Specific examples of the useful compounds are described in U.S. Pat. No. 4,500,626.

The binder which can be used in the light-sensitive material of the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer compound, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

A suitable coating amount of the binder according to the present invention is 20 g or less, preferably 10 g or less, and more preferably 7 g or less, per $m^2$.

A suitable ratio of the organic solvent having a high boiling point which is dispersed in a binder together with a hydrophobic compound such as a dye-providing substance to the binder is 1 ml or less, preferably 0.5 ml or less, and more preferably 0.3 ml or less, per g of the binder.

In the light-sensitive material according to the present invention, the photographic emulsion layer and other binder layers may contain an inorganic or organic hardening agent. It is possible to use a chromium salt (e.g., chromium alum, chromium, acetate, etc.), an aldehyde (e.g., formaldehyde, glyoxal, glutaraldehyde, etc.), an N-methylol compound (e.g., dimethylolurea, methylol dimethylhydantoin, etc.), a dioxane derivative (e.g., 2,3-dihydroxydioxane, etc.), an active vinyl compound (e.g., 1,3,5-triacryloylhexahydro-s-triazine, 1,3-vinylsulfonyl-2-propanol, 1,2-bis(vinylsulfonylacetamido)ethane, etc.), an active halogen compound (e.g., 2,4-dichloro-6-hydroxy-s-triazine, etc.), a mucohalogenic acid (e.g., mucochloric acid, mucophenoxychloric acid, etc.), etc., which are used individually or as a combination thereof.

A support used in the light-sensitive material and the dye-fixing material employed, if desired, according to the present invention is that which can tolerate the processing temperature. As an ordinary support, not only glass, paper, metal, or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. A polyester as described in U.S. Pat. Nos. 3,634,089 and 3,725,070 are preferably used.

In case of using dye-providing substances which release imagewise mobile dyes in the present invention, the transfer of dyes from the light-sensitive layer to the dye-fixing layer can be carried out using a dye transfer assistant.

Specific examples of the dye transfer assistants are described in U.S. Pat. Nos. 4,463,079 and 4,500,626, Japanese Patent Application (OPI) No. 168439/84, etc.

When a dye-providing substance which is colored is incorporated into the light-sensitive material of the present invention, it is not so necessary to further incorporate an anti-irradiation or antihalation substance or various dyes into the light-sensitive material, but in order to improve the sharpness of images, filter dyes or absorbing substances as described in the literature cited in U.S. Pat. No. 4,500,626, etc., can be incorporated into the libht-sensitive material.

The light-sensitive material which can be used in the present invention may contain, if desired, various additives which are known to use in heat-developable light-sensitive materials, and layers other than the light-sensitive layer, for example, an antistatic layer, an electrically conductive layer, a protective layer, an interlayer, an antihalation layer, a stripping layer, etc. Various additives which can be used include those as described in *Research Disclosure*, Vol. 170, RD No. 17029 (June, 1978), for example, a plasticizer, a sharpness-improving dye, an antihalation dye, a sensitizing dye, a matting agent, a surface active agent, a fluorescent whitening agent, a color fading-preventing agent, etc.

The photographic material according to the present invention is preferably composed of a light-sensitive material which forms or releases a dye upon development by heating, and, if desired, a dye-fixing material for fixing a dye. Particularly in a system wherein images are formed by diffusion transfer of dyes, both the light-sensitive material and the dye-fixing material are essential. Typical photographic materials employed in such a system are divided broadly into two embodiments, that is an embodiment in which the light-sensitive material and the dye-fixing material are provided on two supports separately and an embodiment in which both materials are provided on the same support.

The embodiment in which the light-sensitive material and the dye-fixing material are formed on different supports is classified to two types. Specifically, one is a peel-apart type and the other is a non-peel-apart type.

In case of the former peel-apart type, a coated surface of the light-sensitive material and a coated surface of the dye-fixing material are superposed on to each other after imagewise exposure or heat development, and then after formation of transferred images the light-sensitive material is rapidly peeled apart from the dye-fixing material. A support for the dye-fixing material is selected from an opaque support and a transparent support depending on the fact that whether the final image is a reflective type or a transmitting type. Further, a white reflective layer may be provided on the support, if desired.

In case of the latter non-peel-apart type, it is necessary that a white reflective layer is present between a light-sensitive layer of the light-sensitive material and a dye-fixing layer of the dye-fixing material. The white reflective layer can be provided in either the light-sensitive material or the dye-fixing material. In this case, a support of the dye-fixing material is requested to be a transparent support.

One representative example of the embodiment in which the light-sensitive material and the dye-fixing material are provided on the same support is a type in which the light-sensitive material is not necessary to peel apart from the image-receiving material after the formation of transferred images. In such a case, on a transparent or opaque support a light-sensitive layer, a dye-fixing layer, and a white reflective layer are superposed. Examples of preferred embodiments of the layer structure include transparent or opaque support/light-sensitive layer/white reflective layer/dye-fixing layer, or transparent support/dye-fixing layer/white reflective layer/light-sensitive layer, etc.

Another typical example of the embodiment in which the light-sensitive material and the dye-fixing material are provided on the same support is a type in which a part or all of the light-sensitive material is peeled part from the dye-fixing material and a stripping layer is provided on an appropriate position of the material as described, for example, in Japanese Patent Application (OPI) No. 67840/81, Canadian Pat. No. 674,082, U.S. Pat. No. 3,730,718, etc.

The light-sensitive material or the dye-fixing material may form a structure having an electrically conductive heat-generating layer suitable to use as heating means for the purpose of heat development or diffusion transfer of dyes.

In order to reproduce a wide range of color in a chromaticity diagram using three elementary colors, i.e., yellow, magenta, and cyan, it is necessary that the light-sensitive material used in the present invention contains at least three silver halide emulsion layers, each having its sensitivity in a spectral region different from the others.

Typical examples of the combination of at least three silver halide emulsion layers each having its sensitivity in a spectral region different from the others include a combination of a blue-sensitive emulsion layer, a green-sensitive emulsion layer, and a red-sensitive emulsion layer, a combination of a green-sensitive emulsion layer, a red-sensitive emulsion layer, and an infrared light-sensitive emulsion layer, a combination of a blue-sensitive emulsion layer, a green-sensitive emulsion layer, and an infrared light-sensitive emulsion layer, a combination of a blue-sensitive emulsion layer, a red-sensitive emulsion layer, and an infrared light-sensitive emulsion layer, etc. The infrared light-sensitive emulsion layer used herein means an emulsion layer having sensitivity to light in a region of 700 nm or more, and particularly in a region of 740 nm or more.

The light-sensitive material used in the present invention may have two or more light-sensitive emulsion layers which are sensitive to light of the same spectral region, but have different sensitivities, if desired.

It is necessary that each of the above-described emulsion layers and/or light-insensitive hydrophilic colloid layers adjacent to the emulsion layers contain at least one kind of a dye-providing substance capable of releasing or forming a yellow hydrophilic dye, a dye-providing substance capable of releasing or forming a magenta hydrophilic dye, and a dye-providing substance capable of releasing or forming a cyan hydrophilic dye, respectively. In other words, in each of the emulsion layers and/or light-insensitive hydrophilic colloid layers adjacent to the emulsion layers, dye-providing substances capable of releasing or forming hydrophilic dyes having different hues from each other should be incorporated, respectively. If desired, two or more kinds of dye-providing substances having the same hue may be used in mixture. In the case of using dye-providing substances which are originally colored, it is particularly advantageous that the dye-providing substances are incorporated into layers other than these emulsion layers.

The light-sensitive material used in the present invention may contain, if desired, a subsidiary layer, for example, a protective layer, an interlayer, an antistatic layer, an anti-curling layer, a stripping layer, a matting layer, etc. in addition to the above described layers.

Particularly, the protective layer usually contains an organic or inorganic matting agent for the purpose of preventing adhesion. Further, the protective layer may contain a mordant, an ultraviolet light-absorbing agent, etc. The protective layer and the interlayer may be composed of two or more layers, respectively.

Moreover, the interlayer may contan a reducing agent for preventing color mixing, an ultraviolet light-absorbing agent, a white pigment such as $TiO_2$, etc. The white pigment may be incorporated into the emulsion layer in addition to the interlayer for the purpose of increasing the sensitivity.

In order to impart the spectral sensitivity as described above to the silver halide emulsion, the silver halide emulsion may be spectrally sensitized using known sensitizing dyes so as to obtain the desired spectral sensitivity.

The dye-fixing material which can be used in the present invention comprises at least one layer containing a mordant. When the dye-fixing layer is positioned on the surface of the dye-fixing material, a protective layer can be further provided thereon, if desired.

Further, the dye transfer assistant may be sufficiently incorporated into the dye-fixing layer, if desired. The material may comprise a water-absorbing layer or a layer containing the dye transfer assistant in order to control the dye transfer assistant. These layers may be provided adjacent to the dye-fixing layer or provided through an interlayer.

The dye-fixing layer used in the present invention may be composed of two or more layers containing mordants which have mordanting powers different from each other, if desired.

The dye-fixing material used in the present invention may contain, if desired, a subsidiary layer, for example, a stripping layer, a matting layer, an anti-curling layer, etc., in addition to the above described layers.

Into one or more of the layers described above, a base and/or a base precursor for the purpose of accelerating dye transfer, a hydrophilic thermal solvent, a color fading preventing agent for preventing fading of dyes, an ultraviolet light-absorbing agent, a dispersed vinyl compound for the purpose of increasing dimensional stability, a fluorescent whitening agent, etc., may be incorporated.

The binder which can be used in the above described layers is preferably a hydrophilic binder. The typical hydrophilic binder is a transparent or translucent hydrophilic colloid, examples of which include a natural substance, for example, protein such as gelatin, a gelatin derivative, polyvinyl alcohol, a cellulose derivative, etc., a polysaccharide such as starch, gum arabic, etc., and a synthetic polymer compound, for example, dextrin, pullulan, a water-soluble polyvinyl compound such as polyvinyl alcohol, polyvinyl pyrrolidone, acrylamide polymer, etc. Among them, gelatin and polyvinyl alcohol are particularly preferred.

The dye-fixing material may have a reflective layer containing a white pigment such as titanium oxide, etc., a neutralizing layer, a neutralization-timing layer, etc., in addition to the above-described layer depending on the purposes. These layers may be provided not only in the dye-fixing material but also in the light-sensitive material. The compositions of these reflective layer, neutralizing layer, and neutralization-timing layer are described, for example, in U.S. Pat. Nos. 2,983,606, 3,362,819, 3,362,821, and 3,415,644, Canadian Pat. No. 928,559, etc.

It is advantageous that the dye-fixing material according to the present invention contains a transfer assistant described below. The transfer assistant may be incorporated into the above-described dye-fixing layer or a different layer.

In the present invention, a transparent or opaque heat-generating element is provided on a support in the case of adopting current heating as means for development, and can be prepared utilizing heretofore known techniques with respect to a resistance heat generator.

The image-receiving layer used in the present invention includes a dye-fixing layer which can be used in heat-developable color light-sensitive materials. A mordant to be used can be selected appropriately from mordants conventionally used. Among them, polymer mordants are particularly preferred. The polymer mordants include polymers containing tertiary amino groups, polymers containing nitrogen-containing heterocyclic moieties, and polymers containing quaternary cationic groups thereof, etc.

Specific examples of these polymer mordants are described in the literatures cited in U.S. Pat. No. 4,500,626, Japanese Patent Application (OPI) Nos. 60643/85, 118834/85, 119557/85, 122940/85, 122941/85, 122942/85, and 235134/85, etc.

In the present invention, a protective layer, an interlayer, a subbing layer, a back layer, and other layers can be provided by preparing each coating solution and applying it to a support by means of various coating methods such as a dip-coating method, an air-knife-coating method, a curtain-coating method, or a hopper-coating method as described in U.S. Pat. No. 3,681,294 and drying in the same manner as used in the preparation of the het-developable light-sensitive layer, by which the light-sensitive material can be prepared.

Further, if desired, two or more layers may be applied at the same time by the method as described in U.S. Pat. No. 2,761,791 and British Pat. No. 837,095.

As light sources of imagewise exposure in order to record images on the heat-developable light-sensitive material, radiant rays including visible light can be utilized. Generally, various light sources used for conventional color prints can be used, examples of which include tungsten lamps, mercury lamps, halogen lamps such as iodine lamps, xenon lamps, laser light sources, CRT light sources, fluorescent tubes, and light-emitting diodes (LED), etc.

A heating temperature in the step of heat treatment according to the present invention can be in a range from about 80° C. to about 250° C., and preferably from about 110° C. to about 180° C.

The heat treatment step includes the heat development step and the transfer step. A heating temperature in the transfer step can be in a range from the temperature in the heat development step to room temperature. It is preferred to use a temperature up to about 10° C. lower than the temperature in the heat development step.

As heating means for the development step and the transfer step, a simple heat plate, an iron, a heat roller, a heat generator utilizing carbon or titanium white, etc., can be employed.

The dye transfer assistant (for example, water) can accelerate the transfer of images between the light-sensitive layer of heat-developable light-sensitive material and the dye-fixing layer of dye-fixing material. Also, the dye transfer assistant may be previously applied to either one of the light-sensitive layer and the dye-fixing layer or both of them and then the both layers may be superposed.

As heating means for the transfer step, heating by passing through between heat plates or bringing into contact with a heat plate (for example, Japanese Patent Application (OPI) No. 62635/75), heating by bringing into contact with a rotating heat drum or heat roller (for example, Japanese Patent Publication No. 10791/68), heating by passing through in hot air (for example, Japanese Patent Application (OPI) No. 32737/78), heating by passing through in an inert liquid maintaining at a constant temperature, heating by passing through along a heat generator using a roller, a belt, or a guiding material (for example, Japanese Patent Publication No. 2546/69), etc. can be used. Further, a layer of an electrically conductive material such as graphite, carbon black, metal, etc. is superposed on the dye-fixing material and the dye-fixing material is directly heated by turning on an electric current in the electrically conductive layer.

A pressure applied for superposing the heat-developable light-sensitive material and the dye-fixing material can be varied depending on various embodiments and materials to be employed. However, a range of from 0.1 $kg/cm^2$ to 100 $kg/cm^2$, and preferably from 1 $kg/cm^2$ to 50 $kg/cm^2$, is suitable, as described, for example, in Japanese Patent Application (OPI) No. 180547/84.

As means for applying pressure to the hest-developable light-sensitive material and the dye-fixing material, various methods, for example, a method in which these materials are passed through a pair of rollers, a method in which these materials are pressed using a plate of good flatness, etc., can be employed. Further, the rollers or plate used for applying the pressure may be heated in a range from room temperature to the temperature in the heat development step.

According to the present invention, heat-developable light-sensitive materials showing little decrease in sensitivity during preservation before exposure, and thus having improved preservability, can be obtained by the use of silver salt particles which are formed or chemically sensitized in the pressure of at least one kind of compounds selected from the cyclic imino compound represented by formula (I) described above and a mercapto compound represented by formula (II) described above. Further, the light-sensitive materials can provide images having high image density and low fog density upon a short period of developing time and thus have good developing property.

The present invention will be explained in greater detail with reference to the following examples, but the present invention should not be construed as being limited thereto.

EXAMPLE

On a polyethylene terephthalate film support were coated a first layer (undermost layer) to a sixth layer (uppermost layer), as shown below, to prepare a color light-sensitive material having a multilayer structure which was designated as Light-Sensitive Material A. In the following table, the coating amount of each component is set forth in mg/m$^2$.

| | |
|---|---|
| Sixth Layer | Gelatin (1,000 mg/m$^2$), Base Precursor*3 (600 mg/m$^2$), Silica*5 (100 mg/m$^2$), Hardening Agent*6 (100 mg/m$^2$) |
| Fifth Layer (Green-sensitive emulsion layer) | Light-sensitive silver chlorobromide emulsion (bromide: 50 mol %, silver: 400 mg/m$^2$), Benzenesulfonamide (180 mg/m$^2$), Silver benzotriazole emulsion (silver: 100 mg/m$^2$), sensitizing dye D-1 ($1 \times 10^{-6}$ mol/m$^2$), Base precursor*3 (500 mg/m$^2$), Silver salt particles according to the present invention (silver: 100 mg/m$^2$), Yellow dye-providing substance (A) (400 mg/m$^2$), Gelatin (1,000 mg/m$^2$), Solvent having a high boiling point*4 (800 mg/m$^2$), Surface active agent*2 (100 mg/m$^2$) |
| Fourth Layer (Interlayer) | Gelatin (1,200 mg/m$^2$), Base precursor*3 (600 mg/m$^2$) |
| Third Layer (Red-sensitive emulsion layer) | Light-sensitive silver chlorobromide emulsion (bromide: 80 mol %, silver: 300 mg/m$^2$), Benzenesulfonamide (180 mg/m$^2$), Silver benzotriazole emulsion (silver: 100 mg/m$^2$), Sensitizing Dye D-2 ($8 \times 10^{-7}$ mol/m$^2$), Base precursor*3 (450 mg/m$^2$), Silver salt particles according to the present invention (silver: 80 mg/m$^2$), Magenta dye-providing substance (B) (400 mg/m$^2$), Gelatin (1,000 mg/m$^2$), Solvent having a high boiling point*1 (600 mg/m$^2$), Surface active agent*2 (100 mg/m$^2$) |
| Second Layer (Interlayer) | Gelatin (1,000 mg/m$^2$), Base precursor*3 (600 mg/m$^2$) |
| First Layer (Infrared light-sensitive emulsion layer) | Light-sensitive silver chlorobromide emulsion (bromide: 50 mol %, silver: 300 mg/m$^2$), Benzenesulfonamide (180 mg/m$^2$), silver benzotriazole emulsion (silver: 100 mg/m$^2$), Sensitizing dye D-3 ($1 \times 10^{-8}$ mol/m$^2$), Base precursor*3 (500 mg/m$^2$), Silver salt particles according to the present invention (silver: 80 mg/m$^2$), Cyan dye-providing substance (C) (300 mg/m$^2$), Gelatin (1,000 mg/m$^2$), Solvent having a high boiling point*4 (600 mg/m$^2$), Surface active agent (100 mg/m$^2$) Support |

*1 Tricresyl phosphate

*2 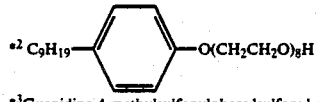

*3 Guanidine 4-methylsulfonylphenylsulfonyl acetate

*4 $(iso\text{-}C_9H_{19}O)_3P{=}O$

*5 Size: 4 μm

*6 1,2-Bis(vinylsulfonylacetamido)ethane

A method for preparing a silver benzotriazole emulsion is described below.

28 g of gelatin and 13.2 g of benzotriazole were dissolved in 3,000 ml of water and the solution was maintained at 40° C. with stirring. A solution of 17 g of silver nitrate dissolved in 100 ml of water was added to the above prepared solution over 2 minutes. The thus prepared silver benzotriazole emulsion was adjusted in pH, precipitated and freed of excess salts. It was then adjusted to pH 6.30, whereby 400 g of a silver benzotriazole emulsion was obtained.

A method for preparing silver chloride particles adsorbed with the compound according to the present invention is described below.

To an aqueous solution (prepared by dissolving 20 g of gelatin and 3.4 g of sodium chloride in 1,000 ml of water and maintained at 45° C.) were added simultaneously an aqueous solution (A) containing 34 g of sodium chloride dissolved in 600 ml of water and an aqueous solution (B) containing 100 g of silver nitrate dissolved in 600 ml of water over 10 minutes at an equal addition amount rate while stirring thoroughly. Further, a solution containing 1.3 g of 2-mercaptobenzimidazole [Compound (27)] dissolved in 150 ml of methanol was added one minute after the start of the addition of solutions (A) and (B) over 10 minutes at an equal addition amount rate. Thus, silver chloride particles adsorbed with 2-mercaptobenzimidazole were prepared. After washing with water and desalting, the resulting mixture was adjusted to pH 6.4, whereby 600 g of the silver salt parrticles according to the present invention was obtained.

A method of preparing the light-sensitive silver halide emulsion for the fifth layer and the first layer is described below.

To an aqueous solution of gelatin (prepared by dissolving 20 g of gelatin and 3 g of sodium chloride in 1,000 ml of water and maintained at 75° C.) were added dropwise simultaneously 600 ml of an aqueous solution containing sodium chloride and potassium bromide and an aqueous solution of silver nitrate (prepared by dissolving 0.59 mole of silver nitrate in 600 ml of water) over 40 minutes at an equal addition amount rate while stirring thoroughly. Thus, a mono-dispersed silver chlorobromide emulsion (bromide content: 50 mol%, crystal form: cubic, average grain size: 0.40 μm) was prepared.

After washing with water and desalting, 5 mg of sodium thiosulfate and 20 mg of 4-hydroxy-6-methyl-1,3,3a,7-tetraazaindene were added and then it was subjected to chemical sensitization at 60° C. The yield of the emulsion was 600 g.

A method of preparing the light-sensitive silver halide emulsion for the third layer is described below.

To an aqueous solution of gelatin (prepared by dissolving 20 g of gelatin and 3 g of sodium chloride in 1,000 ml of water and maintained at 75° C.) were added simultaneously 600 ml of an aqueous solution containing sodium chloride and potassium bromide and an aqueous solution of silver nitrate (prepared by dissolving 0.59 mole of silver nitrate in 600 ml of water) over 40 minutes at an equal addition amount rate while stirring thoroughly. Thus, a mono-dispersed silver chlorobromide emulsion (bromide content: 80 mol%, crystal form: cubic, average grain size: 0.35 μm) was prepared.

After washing with water and desalting, 5 mg of sodium thiosulfate and 20 mg of 4-hydroxy-6-methyl-1,3,3a,7-tetraazaindene were added and then it was subjected to chemical sensitization at 60° C. The yield of the emulsion was 600 g.

A method of preparing a gelatin dispersion of a dye providing substance is described below.

A mixture of 5 g of Yellow Dye-Providing Substance (A) described below, 0.5 g of succinic acid 2-ethylhexyl ester sulfonic acid sodium salt as a surface active agent, 10 g of tri-isononyl phosphate, and 30 ml of ethyl acetate was dissolved by heating at about 60° C. to prepare an uniform solution. This solution was mixed with 100 g of a 10% aqueous solution of lime-processed gelatin with stirring and the mixture was dispersed by means of a homogenizer at 10,000 rpm for 10 minutes. The dispersion thus obtained was designated as a dispersion of yellow dye-providing substance.

A dispersion of magenta dye-providing substance was prepared in the same manner as described above except using Magenta Dye-Providing Substance (B) described below and using 7.5 g of tricresyl phosphate as an organic solvent having a high boiling point.

Further, a dispersion of cyan dye-providing substance was prepared in the same manner for the dispersion of yellow dye-providing substance as described above except using Cyan Dye-Providing Substance (C) described below.

DYE-PROVIDING SUBSTANCE (A)

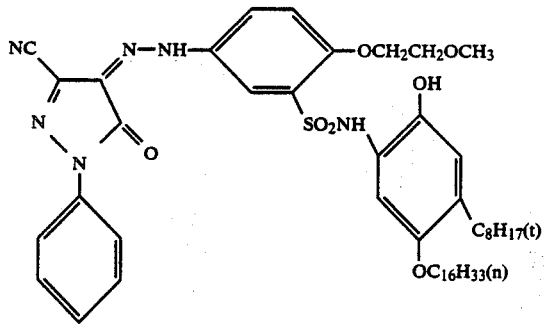

DYE-PROVIDING SUBSTANCE (B)

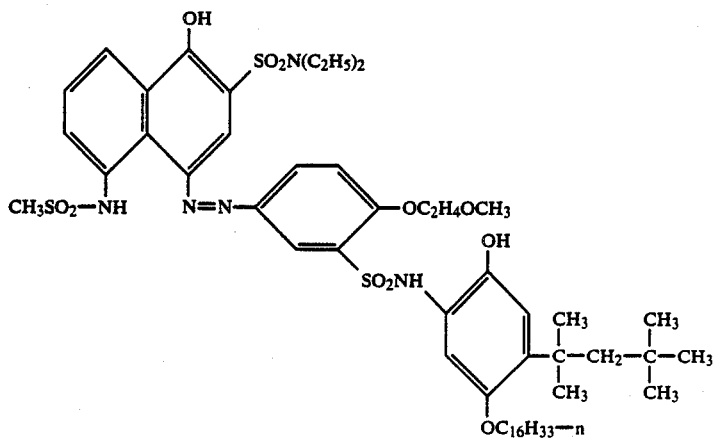

DYE-PROVIDING SUBSTANCE (C)

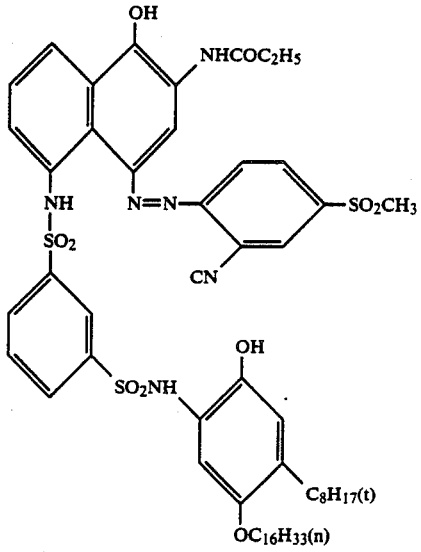

For comparison, Light-Sensitive Material B was prepared in the same manner as described for Light-Sensitive Material A except that the silver chloride particles according to the present invention were not added to the emulsion layers.

A method of preparing a dye-fixing material is described below.

10 g of poly(methyl acrylate-co-N,N,N-trimethyl-N-vinylbenzylammonium chloride) (molar ratio of methyl acrylate to vinylbenzylammonium chloride was 1/1) was dissolved in 200 ml of water and then uniformly mixed with 100 g of a 10% aqueous solution of lime-processed gelatin. The resulting mixture was uniformly coated at a wet layer thickness of 90 μm on a paper support laminated with polyethylene containing titanium dioxide dispersed therein and dried. The thus-prepared material was used as a dye-fixing material having a mordant layer.

The above-described multilayer color light-sensitive materials (Light-Sensitive Materials A and B) were exposed through a three color separation filter of G, R, and IR (G: filter transmitting a band of 500 nm to 600 nm, R: filter transmitting a band of 600 nm to 700 nm, IR: filter transmitting a band of 700 nm or more), the density of which continuously changes, for 1 second at 500 lux using a tungsten lamp and then uniformly heated for 15 seconds or 20 seconds on a heat block which had been heated at 150° C.

The dye-fixing material was supplied with 20 ml per $m^2$ of water on its coated layer and then each of the above described light-sensitive materials subjected to the heat treatment was superimposed on the dye-fixing material in such a manner that their coated layers were in contact with each other. After heating for 6 seconds on a heat block at 80° C., the dye-fixing material was separated from the light-sensitive material, whereupon yellow, magenta, and cyan color images were obtained in the dye-fixing material corresponding to the three color separation filter of G, R and IR, respectively.

The maxiumum density (Dmax) and the minimum density (Dmin) of each color were measured using a Macbeth refection densitometer (RD-519).

The results thus obtained are shown in Table 1.

TABLE 1

| Light-Sensitive Material | Color Image (Three Color Separation Filter) | Developing Time (Sec) | Dmax | Dmin |
|---|---|---|---|---|
| A (Present Invention) | Yellow (G) | 15 | 1.95 | 0.13 |
| | | 20 | 2.00 | 0.13 |
| | Magenta (R) | 15 | 2.25 | 0.14 |
| | | 20 | 2.35 | 0.14 |
| | Cyan (IR) | 15 | 2.45 | 0.12 |
| | | 20 | 2.45 | 0.12 |
| B (Comparison) | Yellow (G) | 15 | 1.50 | 0.13 |
| | | 20 | 1.80 | 0.13 |
| | Magenta (R) | 15 | 1.60 | 0.13 |
| | | 20 | 2.20 | 0.14 |
| | Cyan (IR) | 15 | 1.80 | 0.11 |
| | | 20 | 2.20 | 0.12 |

From the results shown in Table 1, it is apparent that Light-Sensitive Material A according to the present invention provides high maximum density even in the case of a very short period of developing time. Furthermore, the fog is low, and thus the results are satisfactory.

Furthermore, Light-Sensitive Materials A and B just after the preparation, and after being subjected to a preservation test at 50° C. for 3 days, were exposed to light and developed (developing time: 15 seconds) in the same manner as described above. Then, densities of the images thus obtained werre measured and relative sensitivities at the density of 0.5 were determined. The results are shown in Table 2. In Table 2, the relative sensitivities are shown by taking the sensitivity of Light-Sensitive Material B just after the preparation as 100.

TABLE 2

| Light-Sensitive Material | | Relative Sensitivity | | |
|---|---|---|---|---|
| | | Yellow | Magenta | Cyan |
| A (Present Invention) | Just after preparation | 200 | 180 | 200 |
| | After preservation test | 200 | 178 | 195 |
| B (Comparison) | Just after preparation | 100 | 100 | 100 |
| | After preservation test | 85 | 60 | 95 |

From the results shown in Table 2, it is apparent that Light-Sensitive Material A according to the present invention shows only small decrease in the sensitivity, and shows greatly improved preservability in comparison with comparative Light-Sensitive Material B.

These results illustrated above clearly indicate the excellent effects of the present invention.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a support having thereon, at least
   (1) a light-sensitive silver halide;
   (2) a silver salt oxidizing agent;
   (3) silver salt particles having adsorbed thereon at least one compound selected from a cyclic imino compound represented by formula (I)

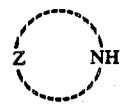

(I)

wherein Z represents a non-metallic atomic group forming a heterocyclic ring containing an imino group together with the nitrogen atom of formula (I), and a mercapto compound represented by formula (II)

R—S—M (II)

wherein M represents a hydrogen atom or an alkali metal atom; and R represents a substituted or unsubstituted aliphatic hydrocarbon group, a substituted or unsubstituted aromatic hydrocarbon group, or a substituted or unsubstituted heterocyclic group;
   (4) a reducing agent; and
   (5) a binder.

2. A heat-developable light-sensitive material as in claim 1, wherein the silver salt particles are salt particles composed of silver ions and chlorine ions, bromine ions, iodine ions, thiocyanate ions, selecyanate ions, sulfite ions, sulfate ions, phosphate ions, or complex ions thereof.

3. A heat-developable light-sensitive material as in claim 1, wherein the silver salt particles are substantially light-insensitive.

4. A heat-developable light-sensitive material as in claim 3, wherein the silver salt particles have a sensitivity of one tenth of or less than tht of the light-sensitive silver halide.

5. A heat-developable light-sensitive material as in claim 1, wherein the silver salt particles are selected from primitive silver chloride particles, primitive silver bromide particles, primitive silver chlorobromide particles, and mixtures thereof.

6. A heat-developable light-sensitive material as in claim 5, wherein the silver salt particles are a fine grain emulsion of primitive silver chloride particles.

7. A heat-developable light-sensitive material as in claim 1, wherein a particle size of the silver salt particles is in a range of from 0.01 μm to 2 μm.

8. A heat-developable light-sensitive material as in claim 1, wherein the silver salt particles are used in an amount of from 1 mol% to 200 mol% of the light-sensitive silver halide.

9. A heat-develdopable light-sensitive material as in claim 8, wherein the silver salt particles are used in an amount of from 5 mol% to 100 mol% of the light-sensitive silver halide.

10. A heat-developable light-sensitive material as in claim 1, wherein the cyclic imino compound is rrepresented by one of formulae (III) to (XI)

(III)

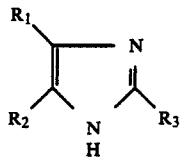

(IV)

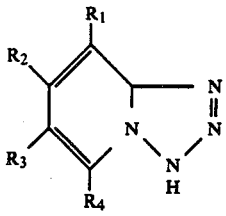

(V)

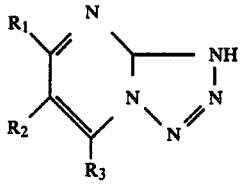

(VI)

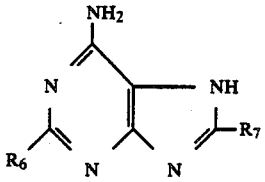

(VII)

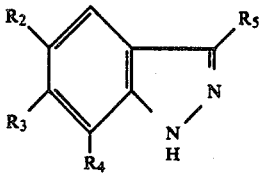

(VIII)

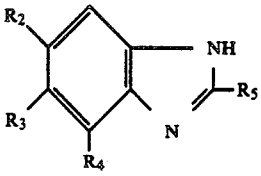

(IX)

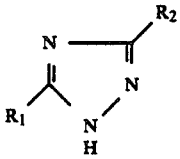

(X)

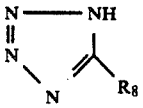

-continued (XI)

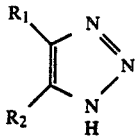

wherein $R_1$, $R_2$, $R_3$ and $R_4$, each represents a hydrogen atom, an alkyl group, an aralkyl group, an alkenyl group, an alkoxy group, an aryl group, —NRR', —COOR", —CONRR', —$NHSO_2R$, —$SO_2NRR'$, —$NO_2$, a halogen atom, —CN, or —OH (wherein R and R' each represents a hydrogen atom, an alkyl group, an aryl group, or an aralkyl group; R" represents an alkyl group, an aryl group, or an aralkyl group and then both $R_1$ and $R_2$ represent alkyl groups, they can be bonded to each other to form an aliphatic hydrocarbon ring, or $R_1$ and $R_2$ in formula (XI) can be further bonded to each other to form an aromatic hydrocarbon ring; $R_5$ represents a hydrogen atom, an alkyl group having from 1 to 5 carbon atoms, or —S—R''' (wherein R''' represents a hydrogen atom, an alkyl group, an aryl group, or an aralkyl group); $R_6$ represents a hydrogen atom or an alkyl group; $R_7$ represents a hydrogen atom, an alkyl group, or an aryl group; and $R_8$ represents an alkyl group, an aryl group, a benzyl group, or a pyridyl group.

11. A heat-devvelopable light-sensitive material as in claim 1, wherein the mercapto compound is represented by formula (XII)

(XII)

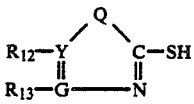

wherein Q represents an oxygen atom, a sulfur atom, or —NR'''' (wherein R'''' represents a hydrogen atom, an alkyl group, an unsaturated alkyl group, a substituted, or unsubstituted aryl group or, a substituted or unsubstituted aralkyl group); Y and G each represents a carbon atom or a nitrogen atom; and $R_{12}$ and $R_{13}$ each represents a hydrogen atom, an alkyl group, an unsaturated alkyl group, a substituted or unsubstituted aryl group, a substituted or unsubstituted aralkyl group, —SR''''' (wherein R''''' represents a hydrogen atom, an alkyl group, an aryl group, an aralkyl group, an alkyl carboxylic acid group or an alkali metal salt thereof, or an alkyl sulfonic acid group or an alkali metal salt thereof) or —$NH_2$; and when both Y and G represent carbon atoms, $R_{12}$ and $R_{13}$ can be bonded to each other to form a substituted or unsubstituted aromatic hydrocarbon ring or a substituted or unsubstituted nitrogen-containing hetero ring.

12. A heat-developable light-sensitive material as in claim 10, wherein the cyclic imino compound represented by formulae (III) to (XI) does not include a carboxylic acid group or a sulfonic acid group.

13. A heat-developable light-sensitive material as in claim 11, wherein the mercapto compound represented by formula (XII) does not include a carboxylic acid group or a sulfonic acid group.

14. A heat-developable light-sensitive material as in claim 1, wherein the silver salt particles are those formed or ripened in the presence of at least one kind of the cyclic imino compound or the mercapto compound.

15. A heat-developable light-sensitive material as in claim 1, wherein the silver salt particles are present in a light-sensitive silver halide emulsion layer.

16. A heat-developable light-sensitive material as in claim 1, wherein the light-sensitive silver halide is chemically sensitized.

17. A heat-developable light-sensitive material as in claim 1, wherein the light-sensitive halide is spectrally sensitized with a sensitizing dye.

18. A heat-developable light-sensitive material as in claim 1, wherein the organic silver salt oxidizing agent is a silver salt of an aliphatic or aromatic carboxylic acid, a silver salt of a compound containing a mercapto group or a thiocarbonyl group having an $\alpha$-hydrogen atom, or a silver salt of a compound containing an imino group.

19. A heat-developable light-sensitive material as in claim 1, wherein part or all of the light-sensitive silver halide, the silver salt oxidizing agent, the silver salt particles, the reducing agent, and the binder are present in the same layer.

20. A heat-developable light-sensitive material as in claim 1, wherein the light-sensitive silver halide and the silver salt oxidizing agent are present in the same layer.

21. A heat-developable light-sensitive material as in claim 1, wherein an amount of the silver salt oxidizing agent is in a range from 0.01 mol to 10 mols per mol of the light-sensitive silver halide.

22. A heat-developable light-sensitive material as in claim 1, wherein the binder is a hydrophilic binder.

23. A heat-developable light-sensitive material as in claim 1, wherein the light-sensitive material further contains an image-forming substance.

24. A heat-developable light-sensitive material as in claim 23, wherein the image-forming substance is a dye-providing substance.

25. A heat-developable light-sensitive material as in claim 23, wherein the dye-providing substance is a coupler capable of reacting with a developing agent.

26. A heat-developable light-sensitive material as in claim 23, wherein the dye-providing substance is a compound having a function of releasing or diffusing imagewise a diffusible dye.

27. A heat-developable light-sensitive material as in claim 26, wherein the dye-providing substance is represented by formula (LI)

$$(\text{Dye—X})_n\text{—Y} \qquad \text{(LI)}$$

wherein Dye represents a dye moiety or a dye precursor moiety; X represents a simple bond or a connecting group; Y represents a group having such a property that diffusibilty of the compound represented by $(\text{Dye—X})_n$—Y can be differentiated in correspondence or counter-correspondence to light-sensitive silver salts having a latent image distributed imagewise or a group having a property of releasing Dye in correspondence or counter-correspondence to light-sensitive silver salts having a latent image distributed imagewise, diffusibility of Dye released being different from that of the compound represented by $(\text{Dye—X})_n$—Y; and n represents 1 or 2 and when n is 2, two Dye—X's are the same or different.

28. A heat-developable light-sensitive material as in claim 27, wherein the dye-providing substance is a dye-releasing compound which has a reducing property.

* * * * *